United States Patent [19]

Wang

[11] Patent Number: 4,905,332

[45] Date of Patent: Mar. 6, 1990

[54] INFLATABLE ARTICLE

[76] Inventor: Tony C. Wang, Room 3, 11th Floor, 311 Sec. 4, Chung-Hsiao-East Road., Taipei, Taiwan

[21] Appl. No.: 306,487

[22] Filed: Feb. 3, 1989

[30] Foreign Application Priority Data

Feb. 4, 1988 [GB] United Kingdom ..... 8802474

[51] Int. Cl.[4] ..... A47C 27/10

[52] U.S. Cl. ..... 5/455; 5/419; 297/380; 297/391; 297/DIG. 3; 441/130

[58] Field of Search ..... 5/455, 449, 441, 465, 5/417, 420, 419; 297/DIG. 3, 380, 391; 441/126, 129–132

[56] References Cited

U.S. PATENT DOCUMENTS

| | | | |
|---|---|---|---|
| 3,122,956 | 12/1963 | Schick et al. | 5/449 |
| 3,408,107 | 10/1968 | Savage | 297/391 |
| 4,836,605 | 6/1989 | Greenwood et al. | 297/DIG. 3 |

*Primary Examiner*—Alexander Grosz

*Attorney, Agent, or Firm*—Parmelee, Bollinger & Bramblett

[57] ABSTRACT

An inflatable article comprises a peripheral inflatable member adapted to be folded on itself about a line, defining two generally similar parts, thereof; and a cushion member attached to the peripheral member along the inside of one of the parts. When folded, the article can be in the form of a chair.

16 Claims, 5 Drawing Sheets

PRIOR ART

INFLATABLE ARTICLE

FIELD OF THE INVENTION

This invention relates to inflatable articles.

BACKGROUND OF THE INVENTION

A number of different kinds of inflatable articles are known, including dinghies, air-beds and inflatable chairs. Such articles are usually manufactured out of several plastics sheets which are sealed together to form the article. Typically, air-beds are made from at least four plastic sheets which are sealed together; manufacture therefore requires several stages.

Some inflatable articles are known which are capable of having their structure changed so that the article can be put to various uses. For example, a rectangular inflatable which might be used as an air-bed can be folded in half, so that one half of the structure forms the back of a chair, to which a seat base can be added, as shown in FIG. 1; alternatively, one half of the structure may rest on the other half to form the seat of a chair to which a back rest and also a head rest may be added, as shown in FIG. 2. However, such articles, like articles which cannot have their structure changed, lack support members within their structure.

When an article such as an inflatable chair lacks support members, it does not provide support for the waist and back of the user; the chair is thus uncomfortable to sit on. Also, the centre of gravity of a user and the chair is such that the user is often likely to be sitting in an unstable position.

An object of the present invention is to provide an inflatable article which is comfortable and that will provide a stable support for the user, in whatever intended use of the article. Another object of the invention is to provide an inflatable article which is simple to manufacture.

SUMMARY OF THE INVENTION

The present invention provides an article comprising a peripheral inflatable member adapted to be folded about a line, defining two generally similar parts, thereof; and a cushion member attached to the peripheral member along the inside of one of the parts. An article of the invention can be simply manufactured; for example, it may comprise two superimposed sheets of plastics material sealed together at predetermined points.

DESCRIPTION OF THE INVENTION

The peripheral member may comprise generally similar components joined to each other at their respective free ends; the points at which they are joined then define the line along which the article may be folded.

It is often preferred that an additional cushion member should be attached to the peripheral member along the inside of the other of the parts. Such an article may be designed to allow breakage of a frangible attachment when the parts are folded on each other, e.g. for use as a chair. Sealing of plastics sheets together can allow for breakage along sealing lines, simply, when required.

Usually as an alternative to the provision of a frangible attachment, it is often preferred that there should be a further inflatable component, generally similar in shape to the parts/components of the defined peripheral member, whose free ends are joined to the peripheral member at respective sides, substantially at the fold line, thereof. Preferably, a further cushion member is attached along the inside of the further component.

Particularly in order to define the shape of the peripheral member, and to provide a smooth contour to the inflated article, each part/component may comprise a plurality of, e.g. three, inflatable chambers which themselves may be generally tubular. For example, the chambers may define a generally U-shaped part/component.

The mid-point (or middle chamber of 3) of each part/component is preferably of the greatest cross-section, when inflated; for example, a U-shaped part/component may have a base of generally greater cross-section than either of its sides. When folded for use as a chair, this construction provides waist and back support.

An article of the present invention is particularly adapted to the formation of a comfortable chair, when folded. For this purpose, it may comprise a head rest. For securing the parts/components when folded, fastening means, such as a fastening strip or a toggle/button arrangement, may be provided. Valves or other means may be provided to allow inflation as necessary FIGS. 1 and 2 are examples of prior art inflatable articles.

The invention will now be described by way of example only with reference to FIGS. 3 to 8 of the accompanying drawings, in which.

Figure 4:
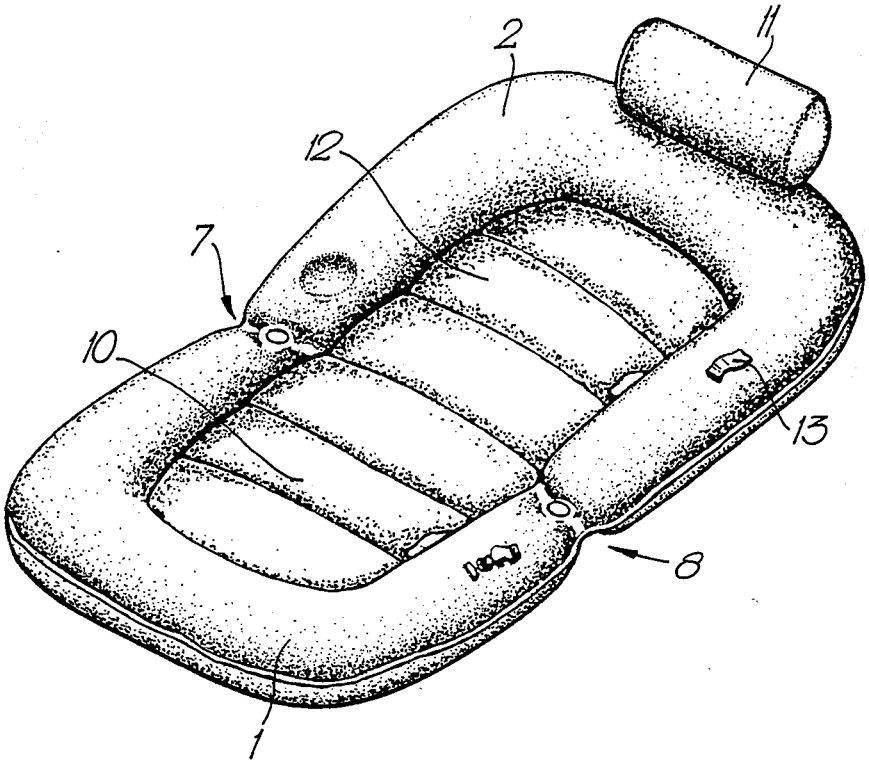
FIG. 4 is a plan view of an embodiment of the invention similar to that of FIG. 3.
Figure 5A:
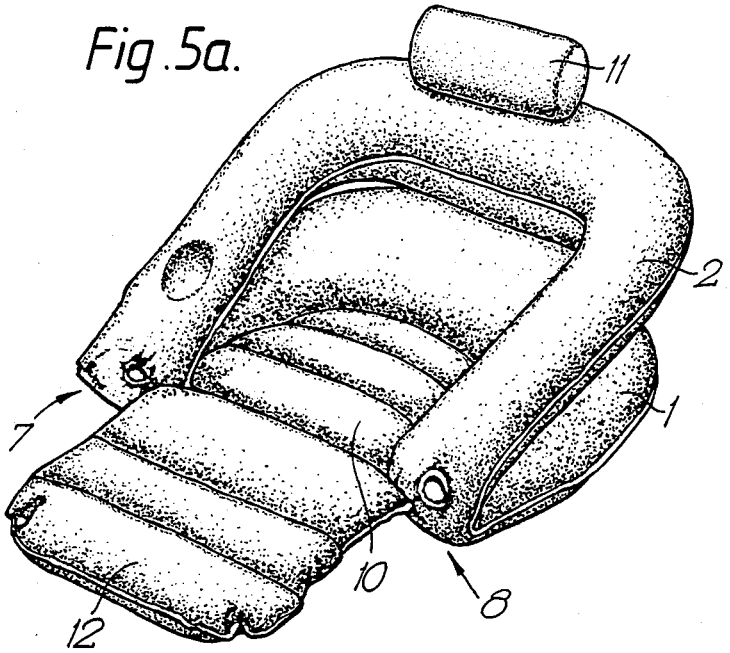
Figure 5B:
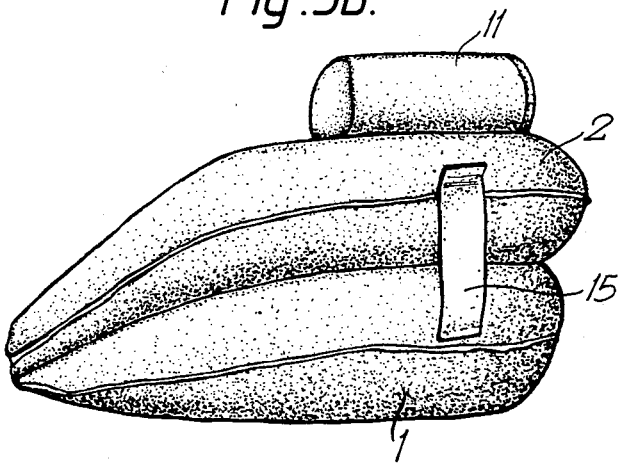
Figure 7:
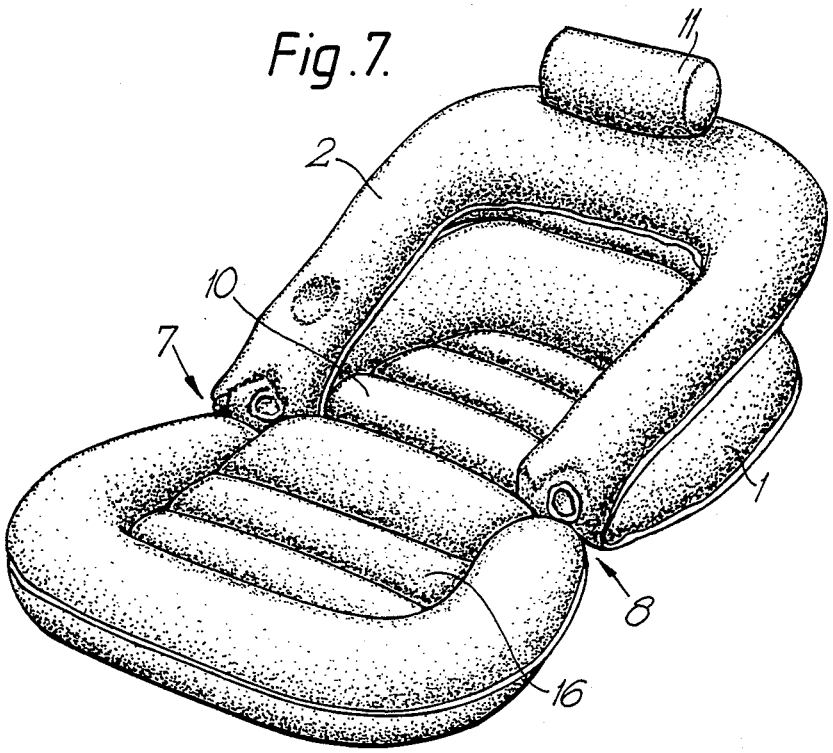
Figure 6:
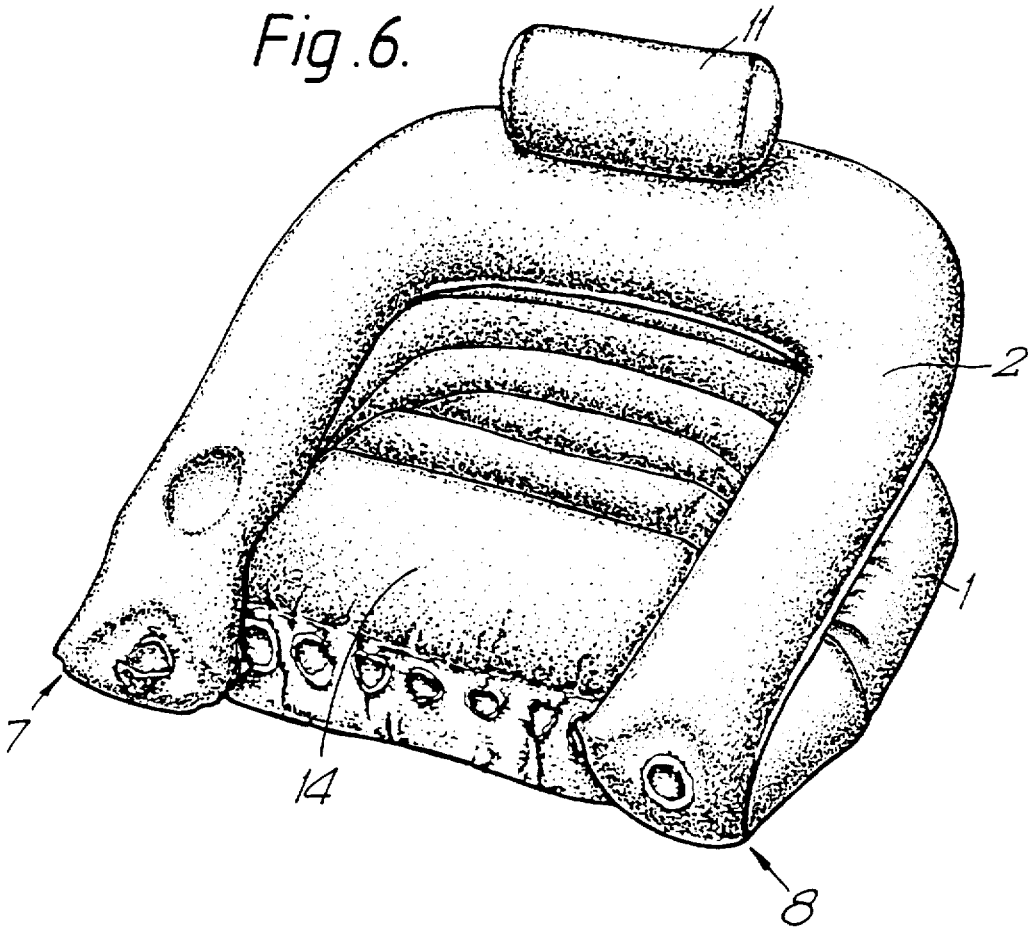

FIGS. 5*a* and 5*b* are respectively a front view and a rear view of an embodiment of the invention similar to that of FIG. 4, when folded for use as a chair;

FIG. 6 is a front view of an embodiment of the invention similar to that of FIG. 5*a*, adapted for use as a chair, and an additional seat base; and FIG. 7 is a plan view of an embodiment of the invention similar to that of FIG. 5*a*, adapted for use as a chair, and including an additional support member for use as a foot rest.

Figure 1:
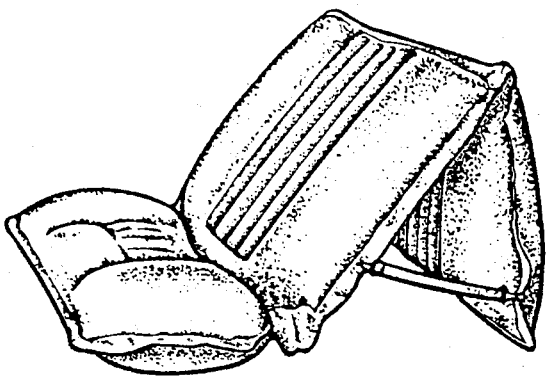
Figure 2:
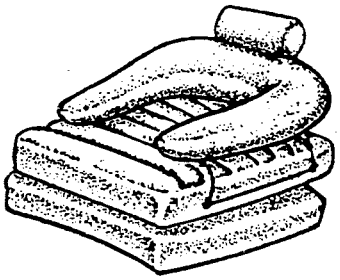
PRIOR ART Fig. 2.
Figure 3:
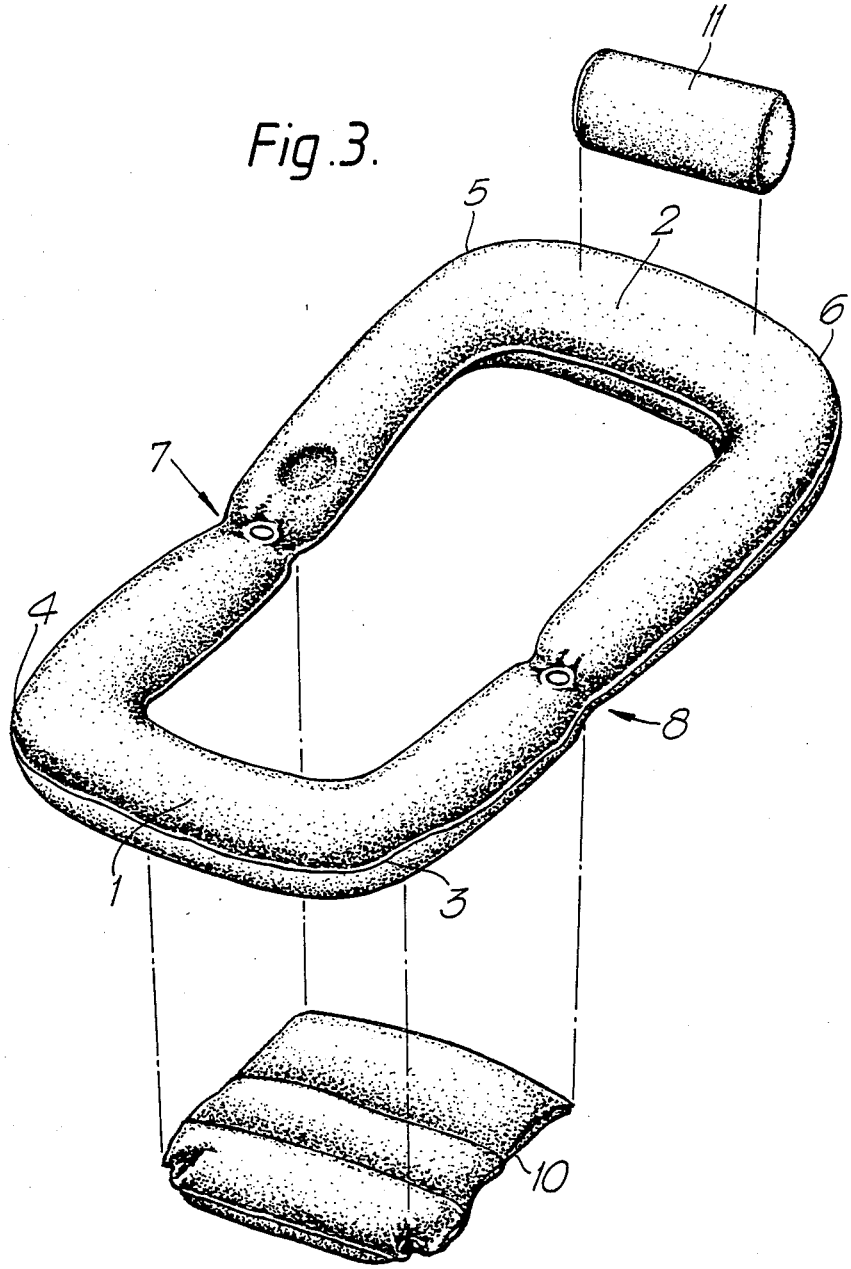
FIG. 3 is an exploded view of an embodiment of the present invention.

FIG. 3 shows an inflatable article comprising first and second U-shaped support members 1,2 joined at their respective ends at points 7,8 which define a fold line allowing the members 1,2 to be easily superimposed. Each of these support members comprises three inflatable chambers, with walls between the chambers at about the respective corners 3,4,5,6. The base of each member 1,2, when inflated as shown, is of greater cross-section than either arm.

A cushion member 10 is attached to the inside of the support member 1, its shape being defined by that member and the fold line. The cushion member 10 serves as a seat when the members 1,2 are superimposed, when the article is inflated and used as a chair. For that purpose, a head rest 11 is provided.

FIG. 4 shows the same components as FIG. 3 and, in addition, a second cushion member 12 attached along the inside of the support member 2. A small strap 13 provides a cover for an inflation valve. Usually, a valve will be provided for each inflatable volume. The embodiment of the invention shown in FIG. 4 floats stably on water, and will also form a stable support when positioned on the ground.

The embodiment shown in FIGS. 5*a* and 5*b* comprises the same components, when folded, as are shown in FIG. 4. A strap 15 is also shown, provided to fasten the support members together.

FIG. 6 shows an embodiment and is a view parallel to that of FIG. 5*a*, except that, in this case, a further cushion member 14 has been superimposed on the cushion member 10 (in which case 14 is equivalent to 12 in FIG. 5*a*) or on a combination of cushion members 10 and 12. This combination of cushions provides a comfortable seat base.

FIG. 7 shows the same components as FIG. 5*a*, except that the further cushion member which is shown has not been detached from inside the support member 2, but is a cushion member 14 attached to the inside of a further support member 16 which can provide additional leg support. This further support member 16 has generally the same shape (and also construction) as the support members 1,2.

I claim:

1. An inflatable article adapted to support a human user in a sitting or lying position comprising a peripheral inflatable member adapted to be folded on itself about a line defining first and second parts of said peripheral member, said first and second parts being generally similar; and a cushion member attached to the peripheral member along the inside of said first part.

2. An inflatable article according to claim 1, which additionally comprises a further cushion member frangibly attached to said peripheral member along the inside of said second part.

3. An inflatable article according to claim 1, wherein said peripheral member comprises sheets of superimposed plastics material sealed together at predetermined points.

4. An inflatable article according to claim 1, which comprises a further inflatable component, generally similar to each of said parts, whose free ends are joined to said peripheral member at respective sides, substantially at said fold line, thereof.

5. An inflatable article according to claim 4, which additionally comprises a further cushion member attached along the inside of said further component.

6. An inflatable article according to claim 4, wherein said further inflatable component is generally U-shaped.

7. An inflatable article according to claim 4, wherein said further inflatable component is of greatest cross-section at its mid-point.

8. An inflatable article according to claim 4, wherein said further inflatable component comprises a plurality of inflatable chambers.

9. An inflatable article according to claim 15, wherein the plurality is 3.

10. An inflatable article according to claim 1, each said part is of greatest cross-section at its mid-point.

11. An inflatable article according to claim 1, adapted to form a chair when folded.

12. An inflatable article according to claim 7, which additionally comprises a head rest.

13. An inflatable article according to claim 1, which additionally comprises means for fastening said parts together, when folded.

14. An inflatable article according to claim 1, wherein each said part comprises a plurality of inflatable chambers.

15. An inflatable article according to claim 14, wherein the plurality is 3.

16. An inflatable article according to claim 1, wherein each said part is generally U-shaped.

* * * * *

UNITED STATES PATENT AND TRADEMARK OFFICE

CERTIFICATE OF CORRECTION

PATENT NO. : 4,905,332

DATED : March 6, 1990

INVENTOR(S) : Tony C. Wang

It is certified that error appears in the above-identified patent and that said Letters Patent is hereby corrected as shown below:

The sheet of drawing consisting of figure 6 should be added as shown on the attached sheet.

Title page, "16 Claims, 5 Drawing Sheets" should read --16 Claims, 6 Drawing Sheets--

Signed and Sealed this

Twenty-first Day of January, 1992

*Attest:*

HARRY F. MANBECK, JR.

*Attesting Officer*

*Commissioner of Patents and Trademarks*